US005463791A

United States Patent [19]

Roden

[11] Patent Number: 5,463,791

[45] Date of Patent: Nov. 7, 1995

[54] SURFACE CLEANING APPLIANCE

[75] Inventor: Michael J. Roden, Gilbert, Ariz.

[73] Assignee: Redfield Engineering, Gilbert, Ariz.

[21] Appl. No.: 299,276

[22] Filed: Sep. 1, 1994

[51] Int. Cl.[6] ..... A47L 5/30

[52] U.S. Cl. ..... 15/320; 15/385

[58] Field of Search ..... 15/320, 322, 385, 15/321

[56] References Cited

U.S. PATENT DOCUMENTS

| | | | |
|---|---|---|---|
| 3,619,848 | 11/1971 | Salzmann | 15/320 |
| 3,624,668 | 11/1971 | Krause | 15/321 X |
| 4,182,001 | 1/1980 | Krause | 15/320 |
| 4,264,999 | 5/1981 | Monson | 15/320 X |
| 4,333,204 | 6/1982 | Monson | 15/320 X |
| 4,339,840 | 7/1982 | Monson | 15/320 X |
| 4,441,229 | 4/1984 | Monson | 15/320 X |
| 4,692,959 | 9/1987 | Monson | 15/320 |
| 4,991,254 | 2/1991 | Roden et al. | 15/321 |
| 5,321,869 | 6/1994 | Kaempf | 15/322 |

*Primary Examiner*—Chris K. Moore

*Attorney, Agent, or Firm*—Cahill, Sutton & Thomas

[57] ABSTRACT

The appliance employs two rotatable head structures, each of which carries for rotation therewith at least one spray nozzle for depositing cleaning fluid and at least one vacuum nozzle for extracting cleaning fluid and debris. The relative positioning of the two head structures is such that the vacuum patterns of the vacuum nozzles of the two structures overlap. In a preferred mode, each head structure carries a plurality of spray nozzles and a like number of vacuum nozzles. The angular spacing between the spray nozzles and the vacuum nozzles on each head may be adjusted. A hydraulic motor powered by the pressurized cleaning fluid may be employed to drive the rotatable head structures.

10 Claims, 4 Drawing Sheets

SURFACE CLEANING APPLIANCE

TECHNICAL FIELD

This invention is concerned with improving apparatus for cleaning a surface, such as a carpet, by spraying a cleaning fluid onto the surface and vacuuming up the fluid and debris from the surface.

BACKGROUND ART

A variety of apparatus for carrying out this cleaning technique have been devised in the past. The simpler systems utilize a hand-held wand with one spray nozzle and one vacuum nozzle, as disclosed in U.S. Pat. No. 4,991,254, granted to James R. and Michael J. Roden on Feb. 12, 1991, for "CLEANING SYSTEM". More complex systems may employ a motor-driven rotating head with multiple spray nozzles and multiple vacuum nozzles. An example of the latter apparatus is described in U.S. Pat. No. 4,264,999, granted May 5, 1981, to Clifford L. Monson for "ROTARY FLOORING SURFACE TREATING DEVICE". That same inventor has also proposed to equip a motor-driven, rotating head with a plurality of vacuum nozzles, each of which is rotatable about its own axis. That apparatus is disclosed in U.S. Pat. No. 4,692,959, granted Sep. 15, 1987, for "ROTARY CLEANER/SCRUBBER MECHANISM".

One undesirable operating characteristic of rotary single head cleaning devices is their tendency to veer off in different directions, depending upon the handling forces that are applied. Control of the heavy, commercial device of, say, 35 to 50 pounds, can be difficult and tiring for the operator.

Lighter weight, domestic floor polishing devices have been equipped with dual, oppositely rotating, brushes or pads to improve their handling characteristics. But the problem with dual head devices in the past has been their tendency to leave an untreated strip of surface between the two heads.

There continues to be a need for a heavy duty, commercial surface cleaning appliance which is easily controlled by the operator and which is capable of effecting uniform cleaning across a wide swath of surface.

DISCLOSURE OF THE INVENTION

This invention provides a cleaning appliance which employs two rotating cleaning heads positioned side by side on vertical axes so that the pattern of vacuum provided by the vacuum nozzles in the two heads overlap. It is also preferred that the spray patterns provided by the spray nozzles of the two heads overlap or at least come together. With this disposition of the cleaning heads, there is no untreated strip of surface between the two heads. The invention also contemplates that the vacuum pattern created by each head may be larger in diameter than the spray pattern of the same head. In this arrangement, a peripheral pattern of each head dry vacuums loose debris before it is sprayed with cleaning fluid.

And the invention further contemplates adjustment of the angular position of the spray nozzles in each head in relation to the position of the vacuum nozzles in that head. This permits adjustment of the time period spray fluid is permitted to remain in contact with the surface being cleaned before it is vacuumed away.

BRIEF DESCRIPTION OF THE DRAWINGS

The invention is disclosed in greater detail hereinafter by reference to the accompanying drawings, wherein.

BEST MODES FOR CARRYING OUT THE INVENTION

Figure 1:
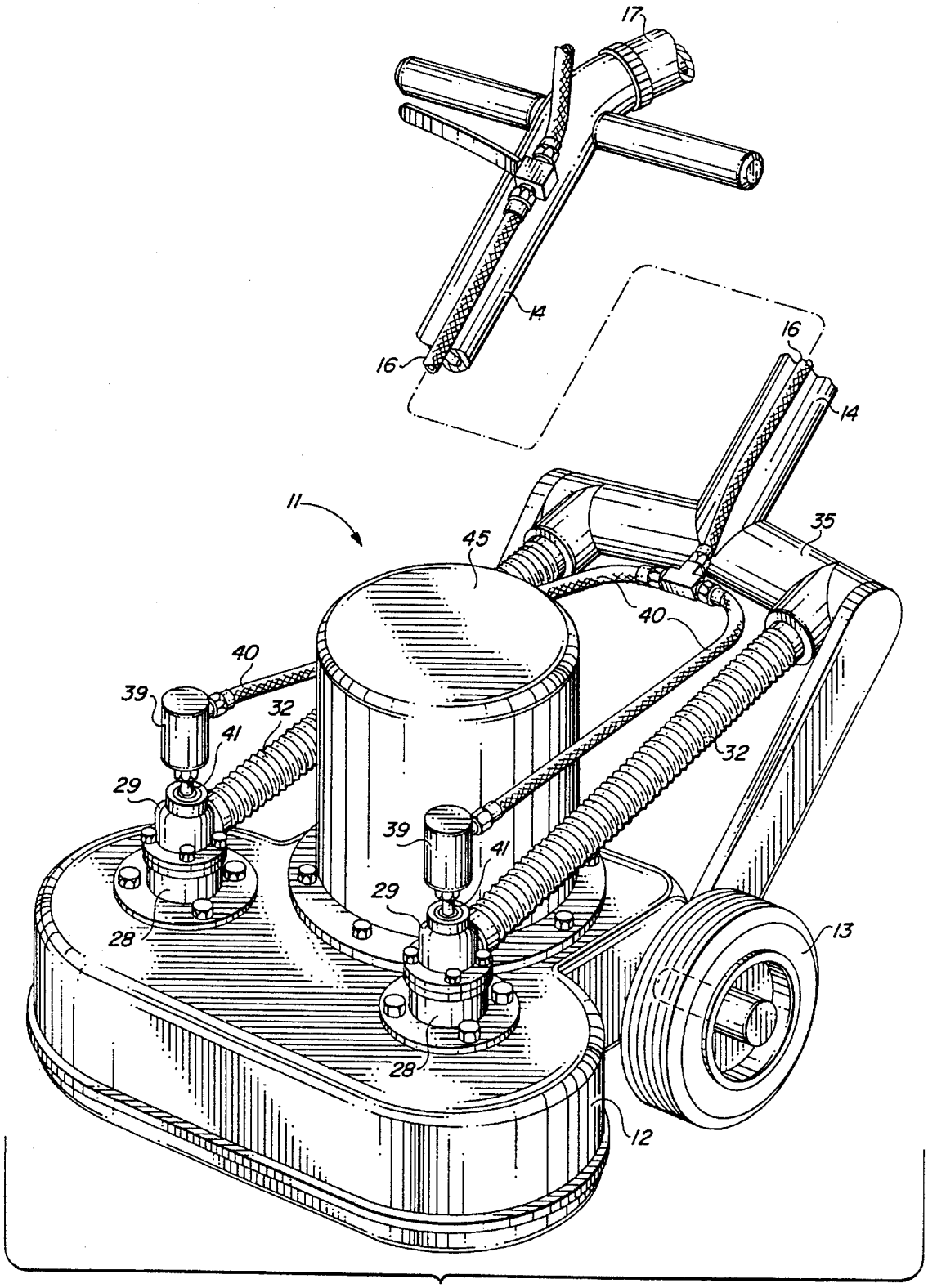
FIG. 1 is a perspective view of a cleaning appliance embodying the several features of this invention.

Referring particularly to FIG. 1, the numeral 11 designates generally the surface cleaning appliance of this invention. The appliance comprises a housing 12 mounted on wheels 13 for movement across the surface, such as a rug, to be cleaned. The appliance is manipulated by means of a handle 14 hingedly attached to the housing 12.

Extending along the handle 14 is a hose 16 and 17 which carries pressurized cleaning fluid, preferably a heated liquid mixture of water and a detergent, to the appliance housing 12. The flow of cleaning fluid through hose 16 is controlled by a hand-manipulated valve 18 on the handle 14. Another hose 17 is connected to hollow handles 14. Hose 17 is a vacuum hose and is considerably larger in diameter than hose 16 so that it can carry a mixture of air, spent cleaning fluid and debris vacuumed from the surface being cleaned.

Hoses 16 and 17 are connected, respectively, to sources of cleaning fluid under pressure and a vacuum, neither of which are shown. Such sources may, for example, comprise the system shown and described in the aforementioned Roden patent.

The physical act of cleaning a surface is accomplished by a pair of rotating heads 19 which are mounted in housing 12 for rotation in side-by-side relationship about vertical axes. (See FIGS. 2 and 3) Each head 19 comprises, in turn, a plurality of vacuum nozzles 21 and a plurality of spray nozzles 22. In the embodiment shown, each rotating head 19 includes three downwardly directed vacuum nozzles 21 which are adapted to contact the surface to be cleaned. The open lower end 23 of each vacuum nozzle 21 extends generally radially of the axis of rotation of each head 19.

For reasons which will be described in greater detail hereinafter, the vacuum nozzles 21 of one head 19 are angularly offset from the vacuum nozzles 21 of the other head. And, the path of travel of vacuum nozzles 21 on one head overlaps the path of travel of the nozzles 21 on the other head. As the heads 19 are rotated in opposite directions at the same speed, their respective vacuum nozzles 21 interdigitate and produce overlapping vacuum patterns. Note the nozzle overlap "0" indicated in FIG. 2.

Synchronized rotation of the two heads 19 is assured by intermeshing ring gears 24 mounted atop the vacuum nozzles 21 in each head. This prevents the vacuum nozzles 21 on one head from contacting the vacuum nozzles on the other head.

Each head 19 also includes three downwardly directed spray nozzles 22 which are interspersed between the vacuum nozzles 21 and positioned above the surface to be cleaned.

Figure 2:
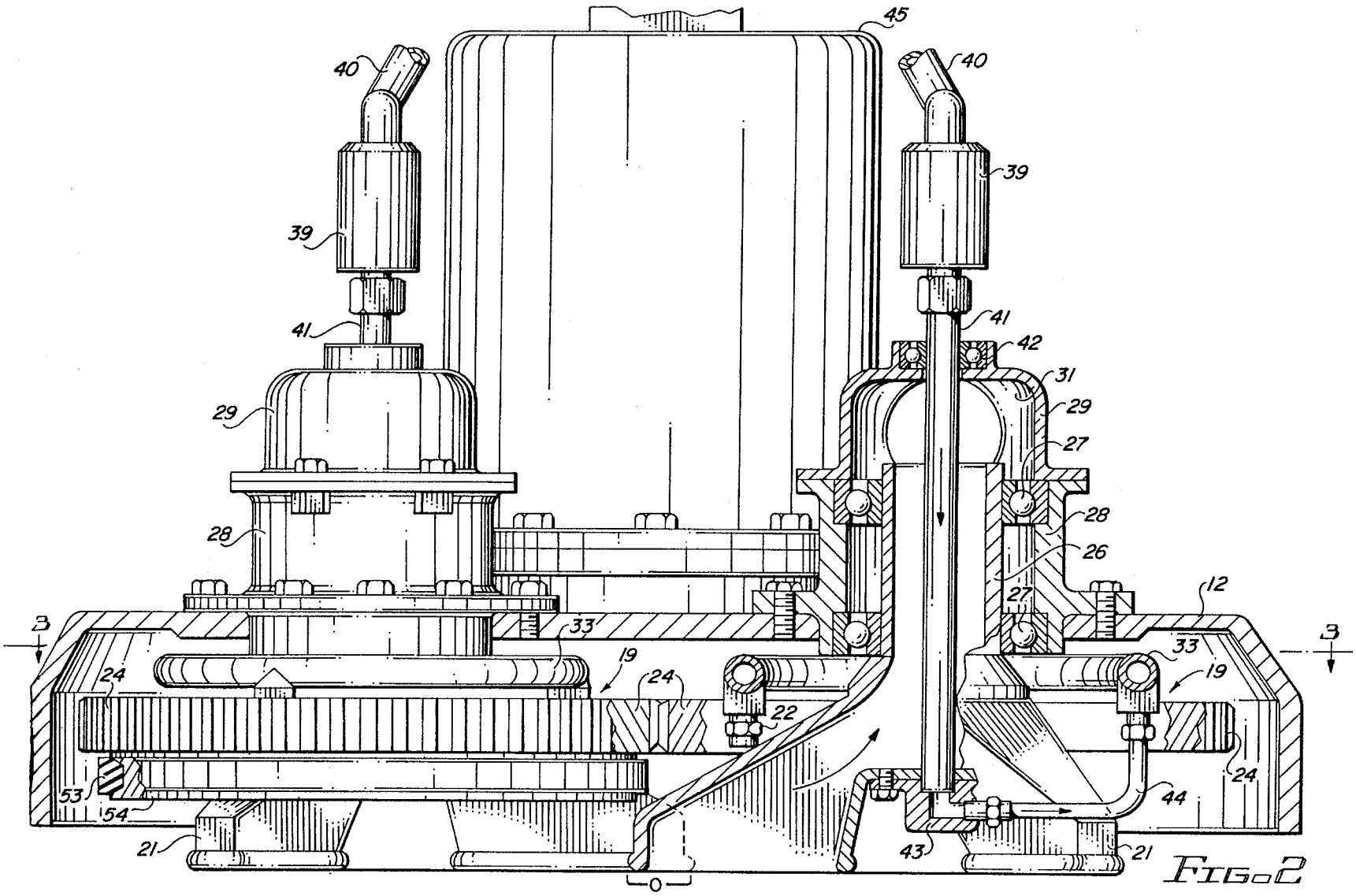
FIG. 2 is an elevational view, partially in section, of the apparatus.

The preferred mounting arrangement for each of the rotating heads 19 is shown on the right hand side of FIG. 2. The three vacuum nozzles 21 on each head are in open communication with an upwardly extending, cylindrical vacuum manifold 26. The manifold 26 is mounted for rotation in bearings 27 carried in a cylindrical sleeve 28 mounted on the upper surface of housing 12. A cap 29 mounted atop each sleeve 28 provides a transition chamber 31 through which air, spent cleaning fluid and debris, pass from rotating vacuum manifold 26 into flexible vacuum hoses 32 which are connected to a vacuum manifold 35 carried by the handle 14. Manifold 35 is in communication with vacuum hose 17 through the hollow handle 14.

The cleaning fluid spray nozzles 22 on each head 19 are carried by and are in communication with a circular supply manifold 33. (See FIG. 4). The supply manifold on each head 19 is mounted by means of brackets 34 which rest atop bosses 36 on the vacuum nozzles 21. (See FIGS. 3 and 4). Bolts 37 passing through slotted openings 38 in the brackets 36 clamp the supply manifold 33 onto the vacuum nozzles 21. The slotted openings 38 in brackets 34 permit the angular displacement of the spray nozzles 22 to be adjusted with respect to the vacuum nozzles 21. This is accomplished by loosening bolts 37 and rotating supply manifold 33 relative to the vacuum nozzles 21. The amount of angular displacement between a spray nozzle 22 and the trailing vacuum nozzle 21 determines the time interval the cleaning fluid is permitted to remain in contact with the surface being cleaned before the cleaning fluid and debris are vacuumed away.

Cleaning fluid is supplied to the spray nozzles 22 on each rotating head 19 from a fluid-tight coupling 39 positioned above each head. Each coupling 39 is connected to a branch 40 of cleaning fluid hoses 16 and communicates with a rotatable pipe 41 carried by a bearing 42 in the upper end of cap 29. Pipe 41 terminates at its lower end in a fitting 43 carried by the vacuum nozzles 21 for rotation therewith. Fitting 43 communicates with a lateral pipe 44 which extends outwardly and upwardly to communicate with spray nozzle ring manifold 33.

Figures 3, 4, 5:
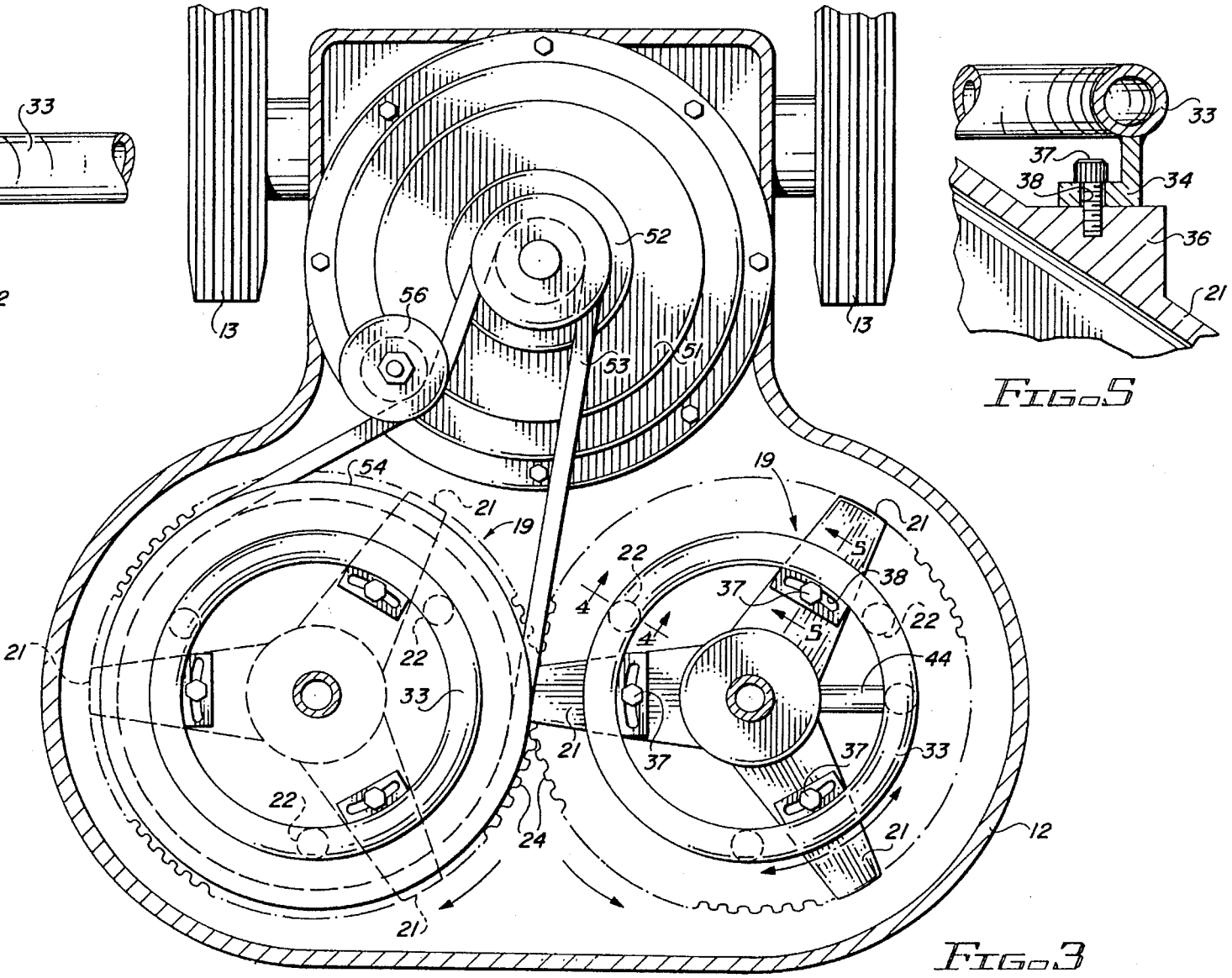
FIG. 3 is a horizontal sectional view taken generally as indicated by line 3—3 in FIG. 2.
FIG. 4 is an enlarged sectional view taken as indicated by line 4—4 in FIG. 3.
FIG. 5 is an enlarged sectional view taken as indicated by line 5—5 in FIG. 3.

The rotation of heads 19 within housing 12 can be imparted by any suitable means, such as an electric motor 45. The drive connection between motor 45 and the rotating heads 19 is illustrated in FIG. 3. A gear reduction unit 51 beneath motor 46 has an output pulley 52. A flexible V-belt 53 transfers rotary motion from pulley 52 to a larger pulley 54 carried by one of the rotating heads 19. An idler pulley 56 may be provided for maintaining tension in the belt 53. The other rotating head 19 is, of course, driven from the belted head by the ring gears 24.

Figure 6:
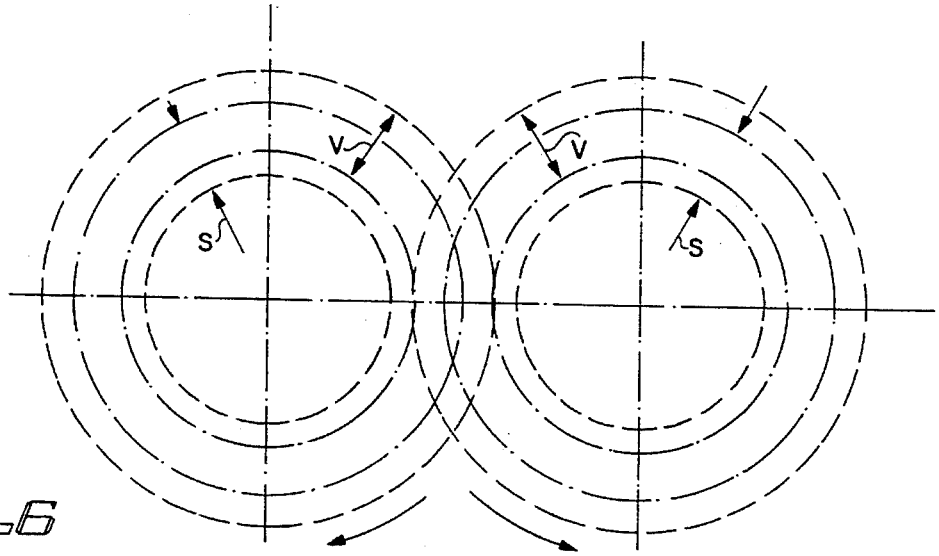
FIGS. 6 and 7 illustrate alternative vacuum and spray patterns which can be achieved with the apparatus of this invention.
Figure 7:
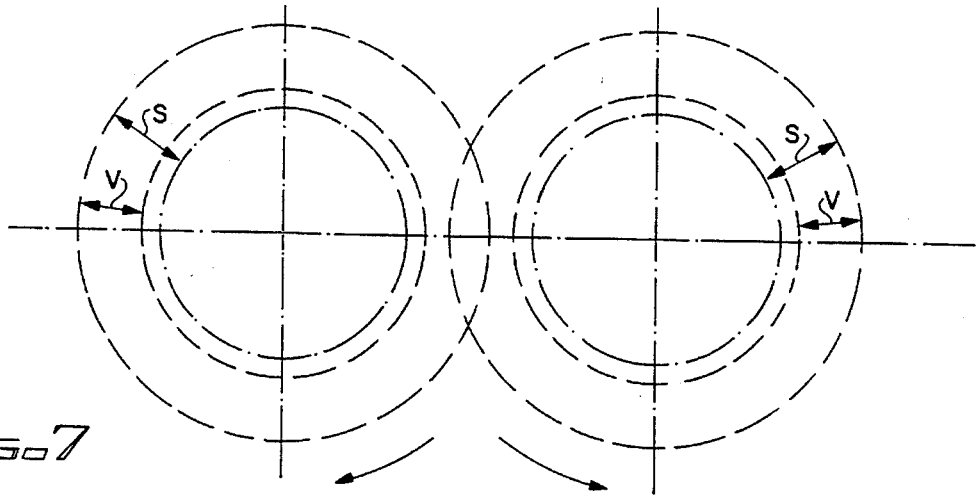

This invention makes further provision for changing the relationship between the cleaning fluid spray pattern and the vacuum patterns produced by the rotating heads. The type of changes that can be affected are illustrated in FIGS. 6 and 7. The annular patterns of vacuum produced by the rotating vacuum nozzles 21 is relatively fixed by the design of the nozzles themselves. However, different sets of spray nozzles 22 can be substituted to change the width of the annular spray pattern produced by the rotating heads.

In the spray and vacuum patterns illustrated in FIG. 6, the outer diameter of the spray pattern, designated with an "S", is caused to be smaller than the outer diameter of the vacuum pattern "V". The larger diameter vacuum pattern provides an annular outer ring for dry vacuuming the surface before it is sprayed. This can be advantageous when there is a great deal of loose, dry debris on the surface that might be more firmly affixed to the surface by the spray.

For most cleaning situations, however, it is desirable to have at least the outer diameter of the spray and vacuum patterns approximately the same. This condition is illustrated in FIG. 7.

Regardless of the spray pattern chosen, whether it be similar to that shown in FIG. 6 or that shown in FIG. 7, it is important that the spray patterns and the vacuum patterns produced by the two heads 19 overlap where they come together between the heads. This insures that no uncleaned strip of surface will be allowed between the two heads.

Figure 8:
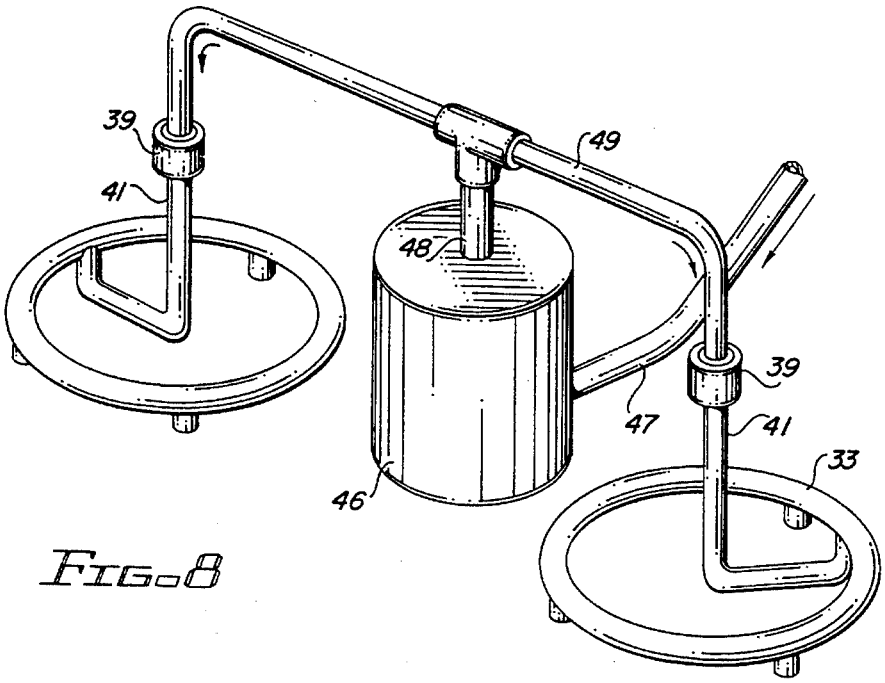
FIG. 8 is a diagrammatic depiction of a cleaning fluid system for an appliance utilizing a hydraulic motor to drive the cleaning heads.

FIG. 8 illustrates diagrammatically the cleaning fluid flow system for an appliance employing a hydraulic motor 46 to drive the cleaning heads 19. Energy to propel the hydraulic motor 46 is supplied by the pressurized cleaning fluid being conveyed to the cleaning heads 19. Cleaning fluid from hose 16 is supplied to the motor 46 via an inlet pipe 47. Cleaning fluid exits the motor through an outlet pipe 48 which is connected to an inlet manifold 49 supplying cleaning fluid to the two fluid-tight couplings 39.

From the foregoing, it should be apparent that this invention provides an improved surface cleaning appliance. The oppositely rotating cleaning heads provide for stable operation and easy manipulation of the appliance. The overlapping spray and vacuum patterns produced assure a wide swath of cleaning surface with no gap between the heads. And, use of a hydraulic motor to drive the heads greatly simplifies the appliance in contrast to electric motor driven appliances.

What is claimed is:

1. A surface cleaning appliance comprising a housing, a pair of rotatable head structures mounted for rotation about parallel vertical axes in said housing, each of said rotatable head structures comprising at least one spray nozzle for spraying cleaning fluid onto the surface to be cleaned and at least one vacuum nozzle for extracting cleaning liquid and debris from the surface, and means for rotating said head structures in opposite directions at the same speed, the spacing between the axes of rotation of said head structures being such that the vacuum pattern of the vacuum nozzle of one head structure overlaps the vacuum pattern of the vacuum nozzle of the other head structure.

2. The cleaning appliance of claim 1, further characterized in that the means for causing rotation of said head structures comprises a hydraulic motor powered by high pressure cleaning fluid supplied to said spray nozzles.

3. The cleaning appliance of claim 1, further characterized in that the liquid spray pattern from the spray nozzle of said one head structure overlaps the liquid spray pattern from the spray nozzle of the other head structure.

4. The apparatus of claim 3, further characterized in that the means for causing rotation of said head structures comprises a hydraulic motor powered by high pressure cleaning fluid supplied to said spray nozzles.

5. A surface cleaning appliance comprising a housing, a rotatable head structure mounted for rotation about a vertical axis in said housing, means for rotating said head structure, said head structure comprising at least one spray nozzle for spraying cleaning fluid onto the surface to be cleaned and at least one vacuum nozzle for extracting cleaning fluid and debris from that surface, said spray nozzle and said vacuum nozzle being mounted on the head structure in a manner to permit the angular displacement between the two to be adjusted.

6. The appliance of claim 5, further characterized in that the mounting of the spray nozzle permits movement thereof in relation to the vacuum nozzle to adjust the angular displacement between the two.

7. The appliance of claim 5, further characterized in that said head structure comprises a plurality of spray nozzles and a like number of vacuum nozzles.

8. The appliance of claim 5, further characterized in that the maximum diameter of the spray pattern created by said spray nozzle is less than the maximum diameter of the vacuum pattern of the vacuum nozzle.

9. The appliance of claim 5, further characterized in that the maximum diameter of the spray pattern created by said spray nozzle is at least as great as the maximum diameter of the vacuum pattern of the vacuum nozzle.

10. The appliance of claim 5, further comprising means for rotating said head structure, said rotating means comprising a hydraulic motor powered by high pressure cleaning fluid supplied to said spray nozzle.

* * * * *